US006989746B2

(12) United States Patent
Rasmussen

(10) Patent No.: US 6,989,746 B2
(45) Date of Patent: Jan. 24, 2006

(54) ALARM CHIP AND USE OF THE ALARM CHIP

(75) Inventor: John Olav Rasmussen, Moi (NO)

(73) Assignee: NorDan AS, Moi (NO)

( * ) Notice: Subject to any disclaimer, the term of this patent is extended or adjusted under 35 U.S.C. 154(b) by 140 days.

(21) Appl. No.: 10/399,846

(22) PCT Filed: Oct. 22, 2001

(86) PCT No.: PCT/NO01/00423

§ 371 (c)(1),
(2), (4) Date: Apr. 22, 2003

(87) PCT Pub. No.: WO02/35490

PCT Pub. Date: May 2, 2002

(65) Prior Publication Data

US 2004/0012502 A1 Jan. 22, 2004

(30) Foreign Application Priority Data

Oct. 26, 2000 (NO) ..... 20005405

(51) Int. Cl.
*G08B 13/00* (2006.01)

(52) U.S. Cl. ..... 340/541; 340/545.1; 340/545.2; 116/86; 160/10

(58) Field of Classification Search ..... 340/541, 340/545.1, 545.2, 545.5, 545.7, 545.8; 116/86; 160/10

See application file for complete search history.

(56) References Cited

U.S. PATENT DOCUMENTS 4,054,867 A 10/1977 Owens
4,070,669 A * 1/1978 Gautier ..... 340/512
4,117,479 A * 9/1978 Galvin et al. ..... 340/502
4,206,449 A * 6/1980 Galvin et al. ..... 340/505
4,206,450 A * 6/1980 Harden et al. ..... 340/577
4,523,184 A * 6/1985 Abel ..... 340/539.16
4,568,920 A 2/1986 Mombelli
4,757,303 A * 7/1988 Scheidweiler ..... 340/501
4,850,018 A * 7/1989 Vogt ..... 705/63
5,828,317 A * 10/1998 Togashi ..... 340/825.69
2004/0113778 A1 * 6/2004 Script et al. ..... 340/545.1

FOREIGN PATENT DOCUMENTS

DE 38 28 486 3/1990
GB 2023318 12/1979

(Continued)

*Primary Examiner*—Daniel Wu
*Assistant Examiner*—Samuel J. Walk

(57) ABSTRACT

An alarm chip (10) and the use of the alarm chip (10) for giving warning of burglary or undesired entry into buildings, installations or structures, preferably by so-called shell-protection of the building, installation or structure, the alarm chip (10) detecting, by means of an associated accelerometer, motions/vibrations in the object to which the alarm chip (10) is fixedly arranged, the object being formed of e.g. a window (2), a door, possibly a frame or casing connected to the window (2) or door, wherein the motions/vibrations are converted by means of the accelerometer into an outgoing flow of acceleration values, which are further processed, by means of a processor in a signal processing circuit, in which, by means of algorithms, the acceleration values are recognized and separated into either output alarm signals or output non-alarm signals, and in which output signals may be coded/encrypted, so that each alarm chip (10) has i.a. a unique address and identity, and in which the signals are possibly also output in the form of signal pulses, preferably in a so-called pseudo-random order, the output signals being transmitted, preferably in a wireless manner, to at least one central and/or external alarm unit/alarm system arranged to the building, installation or structure.

17 Claims, 1 Drawing Sheet

FOREIGN PATENT DOCUMENTS

Figure 1:
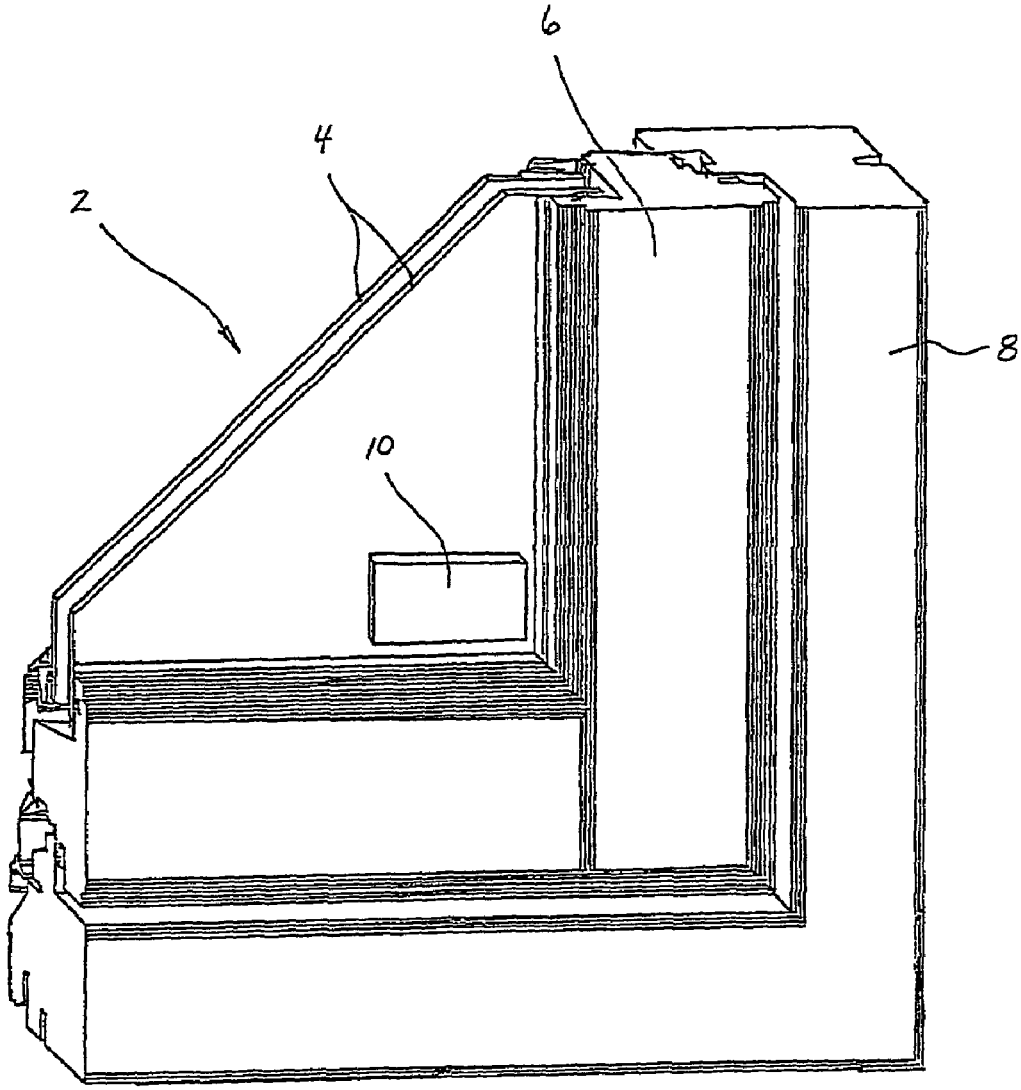

| | | |
|---|---|---|
| GB | 1581479 | 12/1980 |
| GB | 2088107 | 6/1982 |
| GB | 2295230 | 5/1996 |

* cited by examiner

ALARM CHIP AND USE OF THE ALARM CHIP

CROSS REFERENCE TO RELATED APPLICATION

The present application is the U.S. national stage application of International Application PCT/NO01/00423, filed Oct. 22, 2001, which international application was published on May 2, 2002 as International Publication WO 02/3 5490. The International Application claims priority of Norwegian Patent Application 2000 5405, filed Oct. 26, 2000.

FIELD OF THE INVENTION

The invention relates to an alarm chip and the use of the alarm chip, the alarm chip preferably being used in connection with so-called shell-protection of buildings, installations or structures, wherein the shell-protection is preferably arranged to give warning of burglary or undesired entry into the building, installation or structure, but wherein the shell-protection possibly also has a preventive effect on possible intruders, the alarm chip preferably being positioned on windows or doors, possibly on or in associated frames or casings, of the building, installation or structure so that a burglary attempt, if any, is thereby detected, registered and communicated to at least one alarm unit/alarm system located centrally and/or externally and arranged to the building, installation or structure.

BACKGROUND OF THE INVENTION

The background of this invention is the limitations, drawbacks or problems connected to known technical solutions and equipment and in particular sensors and sensor techniques in connection with alarms that are used in order to give warning of burglary or undesired entry into buildings, installations or structures.

KNOWN TECHNIQUE

Sensors, also called detectors, and sensor techniques applied for picking up signals with the aim of registering and giving warning of a burglary attempt or other undesired entry into for example buildings, are known in several variants.

Among other techniques, a so-called vibrator technique is used, in which a low-energy oscillator is mounted on the glass of a window or door, possibly on the associated frame or casing, the oscillator continuously vibrating the glass of the window or door at a particular frequency. By breakage of the glass, frame or casing the vibration stops or is disturbed and the alarm is activated.

Another well-known technical solution is to use a so-called passive infrared ray detector (PIR detector) which emits infrared rays in continuous pulses, the detector normally being mounted inside in the ceiling or on the wall of a building. If the infrared ray pulses are disrupted by a moving object, this is registered through the detector and the alarm is activated.

Acoustic detectors are also available, provided with an acoustic sensor which picks up, e.g. when glass is being broken, the associated acoustic frequency pattern, after which an alarm signal output activates an associated alarm. More recent detectors of this type are provided with equipment which may pick up signals ranging over the entire acoustic frequency spectrum, such detectors being arranged to recognize and distinguish alarm-justifying (real) frequency patterns from non-alarm-justifying (false) frequency patterns. Normally such acoustic detectors are mounted free-standing in the ceiling or on the wall of a building, whereas some types may be inserted into the window frame or casing.

Further, there are sensors that pick up shock-like motions or vibrations caused for example by a burglary attempt in a building, the sensors being based on seismology technology. Such sensors are often used in so-called accelerometers, the most common accelerometers being provided with sensors in the form of piezoelectric crystals which are sensitive to physical influence, e.g. vibrations, and the piezoelectric crystals generating, by such influence, measurable electric voltage. Such vibrations may be characterized by a course of vectorial accelerations, for example in the form of oscillations at one or more frequencies, possibly in the form of one or more frequency patterns, this course of acceleration of said crystals being transformed into a corresponding course of electric voltage output signals which may be registered and possibly processed further. Burglary-related vibrations, for example related to an attempt to break, smash, drill or saw through a window, a door or an associated frame or casing, could thereby be detected, after which a connected alarm is activated. Apart from the seismological use, accelerometers are used in a number of connections and for various purposes. For example, they are used extensively for navigation purposes, for example in connection with so-called inertial navigation, in which accelerometers are integrated together with other equipment to indicate the exact position of an object, e.g. an aeroplane or a boat, relative to a known starting position. An accelerometer may otherwise be used as a signal pick-up in a microphone or in a pick-up head of a record-player. Accelerometers are also used in connection with air bags in vehicles, in which, for example, vibrations related to collisions are detected by an accelerometer.

The use of so-called magnet contacts is a well-known technical solution to prevent burglary attempts or other undesired entry into a building, for example. The function of magnetic contact sensors is based on magnetic balance between a permanent magnet and a cooperating electrically activated magnet, the permanent magnet being placed, for example, on a side surface of a window frame or a door leaf, whereas the electrically activated magnet is positioned in the window or door casing in a position adjacent to the permanent magnet. When current is supplied to the electrically activated magnet, this magnet is in magnetic contact and balance with the permanent magnet, which condition is considered as-a normal condition when the magnet is activated. By a change in the relative positions of the two cooperating magnets, for example in that the window or door leaf is broken open and moved relative to the associated casing, possibly by being influenced by an external magnet, the magnetic balance between the two cooperating magnets is broken, and a connected alarm is thereby activated. Magnetic contact sensors are available in different embodiments, it normally being possible to choose between surface-mounted, inserted or overlying magnet contacts. Such magnetic contact sensors are often used as an additional protection together with other sensors and sensor techniques, normally together with passive infrared ray detectors.

Laser technique is also used in connection with alarm systems. Through a laser device movements both in and outside the room, in which the laser device is located, are detected, this unlike for example a passive infrared ray detector, which only detects movements in the room in question where the detector is placed.

In buildings, installations or structures for which protection is desired, the transmission of signals is normally carried out by means of at least one cabled connection between the sensor(s) and a central and/or external alarm unit/alarm system arranged to the building, installation or structure, but it is also possible to transmit signals through wireless connections. Besides, it is technically possible to transfer signals through, for example, the existing power network of a building, possibly through optical-fibre cables.

DRAWBACKS OF KNOWN TECHNIQUE

The different known variants of alarm sensors used, are encumbered with number of drawbacks.

Many of the above-mentioned sensors utilize technology which is unsatisfactorily developed with respect to giving warning of burglary or other undesired entry into a building, installation or structure, or the technology/sensor is, at the present time, too expensive to be used for this purpose, for example the acoustic detector and the laser device.

In addition, some of these sensors, for example the low-energy oscillator, is difficult to calibrate, in the sense that it is difficult to distinguish real signals (alarm signals) from false signals (non-alarm signals), and that the sensors therefore often output alarm signals in connections where no burglary is committed or there is no undesired entry into a building, for example.

The passive infrared ray detector (the PIR detector) is by and large arranged, and is used, for protecting rooms in buildings, installations or structures, and this detector therefore does not provide any shell-protection for the building, installation or structure.

The use of magnetic contact sensors does not provide any protection against the breaking of glass.

In addition the most common devices for burglary protection, such as PIR detectors and magnetic contact sensors, entails the disadvantage that in the building, for example, junction boxes will have to be installed and wires must be laid for the power supply and/or signal transmission between the detector and the central and/or external alarm unit/alarm system arranged to the building. This is particularly disadvantageous when such equipment is retrofitted into existing buildings, in which the cabling may often be labour-intensive and expensive. The last-mentioned burglary protection devices also require that the user is careful about activating or deactivating the devices, as required, so that an undesired alarm is prevented.

Signal transmission through the existing power network of a building, installation or structure, possibly through an optical-fibre cable, is not arranged to be used in alarm installations at the present time, and it is particularly the use of an optical-fibre cable which seems, at the present time, too expensive to be used for this purpose.

OBJECT OF THE INVENTION

The object of the invention is to provide an alarm chip which is preferably, but not necessarily, used in connection with shell-protection of buildings, installations or structures, in which, in use, the alarm chip is to give warning of a burglary attempt or an attempt at undesired entry into buildings, installations or structures. It should be possible for the alarm chip to be manufactured with small external dimensions, a small power consumption, preferably wireless signal transmission and at a competitive price. Besides, alarm chips arranged to one access opening each, should preferably allow independent connection to a central and/or external alarm unit/alarm system. Properly arranged to the access openings of a building, an installation or a structure, the alarm chip should be able to replace, completely or partially, known sensors or sensor techniques connected to an alarm unit or an alarm system, the above-mentioned drawbacks of known technique thereby being avoided or reduced.

REALIZATION OF THE OBJECT

The object is realized through the use of an alarm chip which is arranged with the equipment and components necessary for realizing the object of the invention. The alarm chip is preferably disposed on the glass of the windows and/or doors of a building, an installation or a structure, possibly disposed on or inserted into associated frames or casings, possibly disposed on or inserted into a glassless door or the casing thereof, the signal transmission preferably being implemented by means of a wireless connection between the alarm chip and at least one central and/or external alarm unit/alarm system arranged to the building, installation or structure.

The alarm chip is provided with components and equipment which are assembled entirely or partly in a printed circuit board, and in which the components are constituted by at least an accelerometer, a signal transmitter preferably formed by a radio frequency transmitter (RF transmitter), and an energy source, preferably a lithium battery. The alarm chip may additionally be provided with an analogue-to-digital converter (ADC-component) and an electronic processor connected to an electronic signal processing circuit, preferably a so-called ASIC (ASIC=application-specific integrated circuit), the ADC-component possibly also being included in the signal processing circuit, the signal processing circuit comprising the so-called intelligent part of the signal processing. Alternatively, the signal processing circuit, possibly including the ADC-component, may be positioned separate from, but still connected to, the alarm chip, this signal processing circuit being positioned, for example, in or at the alarm unit/alarm system arranged to the building, installation or structure.

As mentioned, an accelerometer is provided with at least one sensor (signal pick-up device), for example piezoelectric crystals, arranged to pick up movements/vibrations and convert them into analogue electric signals. These signals may possibly be processed further by means of suitable electronic components arranged to the accelerometer or signal processing circuit, the output signals from said sensor (s) being converted into output signals in the form of a measurable electric quantity, e.g. voltage, current, resistance or capacitances Such electronic components may also process the signals output from said sensor(s), so that the output signals will have a proportional (linear) relation to the acceleration values measured possibly so that the output signals will have a form of non-linear relation to the acceleration values measured.

The accelerometer may be provided with one or more sensors, wherein the sensor(s) may detect motions in one direction (one-dimensional), two directions (two-dimensional) or three directions (three-dimensional) and this in time with the movement(s) or vibration(s), e.g. material vibrations and vibration patterns, which are transferred to the alarm chip upon physical influencing of the medium, e.g. a window or a door, to which the alarm chip is fixedly arranged. This physical influence may be constituted by normal influencing forces in the form of knocking, scraping, rain, hail, wind or acoustic waves/noise. In this connection, abnormal influencing forces are constituted mainly by the movements caused by the breaking of the glass of a window or door and/or breakage of an associated frame or casing, possibly breakage of a glassless door and/or the door casing thereof. As mentioned, all such movements may be characterized by successive vectorial accelerations (changes in direction and speed) that the sensor(s) continuously detect in use. Each individual normal or abnormal influential force thereby gives rise to one or more specific patterns of motional change. As the glass of a window breaks, there will be picked up, in the accelerometer, for example an initial strong acceleration course and possible successive short-duration material vibrations of a particular frequency and rapidly decreasing intensity (amplitude), so that a particular composition, or pattern, occurs in the vectorial course of acceleration of the material vibrations, this course consisting, as mentioned, of changes in both direction and speed.

Analogue output signals are transferred from the accelerometer to the ADC-component, the ADC-component preferably being arranged to an electronic signal processing circuit placed in the alarm chip. Alternatively, analogue or digital output signals may be transferred, preferably in a wireless manner, to a signal processing circuited located externally to the alarm chip and within or at said alarm unit/alarm system, a possible transmission of analogue output signals assuming that an ADC-component is disposed for example in the external signal processing circuit connected to the alarm unit/alarm system. The signal processing circuit may be present for example in the form of soft-ware driven by a processor in a general computer connected to the alarm unit/alarm system.

In the ADC-component the analogue signals output from the accelerometer are converted into digital output signals, which may then be signal processed/registered in the electronic signal processing circuit (preferably an ASIC).

The signal processing circuit is arranged to register continuously accelerations (dv/dt) in the form of one or more specific patterns of motional change corresponding to one specific influencing force. In the signal processing circuit and by means of said electronic processor, the digital acceleration signals, among others, are filtered continuously and compared with known patterns of motional change corresponding to normal or abnormal influencing forces. Such known patterns of motional change have been pre-programmed into the signal processing circuit, the signal processing circuit being arranged, at the same time, to be able to distinguish normal patterns of motional change from abnormal patterns of motional change. For the recognition and distinguishing of specific patterns of motional change, so-called algorithms, preferable seismological algorithms, are used. Such algorithms provide, in the form of programs, a series of instructions as to how the incoming flow of acceleration values is to be signal-processed, including how signal characteristics of patterns of motional change corresponding to normal and abnormal influencing forces are to be recognized and distinguished from each another, the incoming acceleration values being available in digital form (from the ADC-component) as a flow of instantaneous values of the accelerations (dv/dt) measured by the accelerometer. By normal patterns of motional change, possibly also when there are no movements, the signal processing circuit outputs a non-alarm signal (a so-called "alive & well" message), whereas by abnormal motional change patterns the signal processing unit outputs an alarm signal.

For security reasons all signal communication between the alarm chip and the alarm unit/alarm system should be arranged in such a way, that a possible intruder may not manipulate, disturb or put the signals out of function. This problem may be avoided or reduced by coding/encrypting, and this by means of said processor, the output signals of the signal processing circuit, for example by outputting the signals in one or more specific signal formats, possibly by changing the signal formats at regular or irregular intervals, before they are output from the alarm chip. The encryption of the signals complicates the possible use of, for example, a separate radio transmitter, which is to transmit, for example by a burglary, false non-alarm signals after the alarm chip has been eliminated. Besides, the output signals preferably consist of both alarm signals and non-alarm signals ("alive & well" messages), in which case the output signals in normal circumstances mainly consist of "alive & well" messages. By transmitting "alive & well" messages to the alarm unit/alarm system it is continuously confirmed that there are no abnormal conditions, e.g. a burglary, at the access opening where the alarm chip is disposed. This makes the possible use of e.g. a radio interference source in order to block or disturb the output signals of the alarm chip difficult since the alarm unit/alarm system is continuously expecting to receive an "alive & well" message.

The output signals are preferably output in more or less continuous signal pulses, which requires electrical energy. When the alarm chip is provided with a battery as energy source, frequent output of "alive & well" messages will increase the power consumption of the alarm chip, so that the battery is thereby emptied unnecessarily fast. Therefore, it is desirable that emission of "alive & well" messages should be limited to the necessary minimum. In order to limit this power consumption, a so-called pre-filtering of incoming acceleration signals may be carried out in the signal processing circuit. In this pre-filtering the signals are first processed in a simplified part of said algorithms, in which the course of acceleration corresponding to simple and/or frequently occurring normal motional changes or motional change patterns are recognized. On recognition of acceleration courses corresponding to such motional changes/change patterns, the signal processing unit is arranged, for the purpose of saving power, to stop the forwarding of the signals to the alarm unit/alarm system.

The transmission of such messages at regular intervals represents, at the same time, a security risk, as the message frequency thereby will be predictable and may be taken advantage of by a potential intruder. Therefore, it is also desirable that the message frequency is more or less unpredictable. A preferred solution to this problem is to transmit coded/encrypted "alive & well" messages in a so-called pseudo-random sequence, each message containing for example information to the alarm unit/alarm system about the identity of the alarm chip, when the next message will be sent and which coded/encrypted format this message will be available in, so that by each message the alarm unit/alarm system will be prepared to receive and decode an "alive & well" message, or alternatively to activate an alarm by any irregularities in the expected signal.

The transfer of signals between the alarm chip and an alarm unit/alarm system located centrally and/or externally, possibly through an externally located signal processing circuit, may be carried out by means of a cabled or preferably a wireless connection. Wireless transmission of signals is implemented by means of a transmitter, preferably a radio frequency transmitter, arranged to the alarm chip. At the same time, the external alarm unit/alarm system, possibly the external signal processing circuit, has a cooperating and compatible receiver, preferably a radio frequency receiver, arranged thereto, this receiver possibly being arranged also to receive signals from other alarm chips correspondingly arranged to the access openings of the building, installation or structure.

In other respects, the components of the alarm chip are driven by an energy source, e.g. a lithium battery, built into the chip, this type of battery having a long life and being able to supply electrical current at an approximately constant voltage throughout the life of the battery.

Generally, an accelerometer is used to detect motional changes in a moving object, there being emitted by abnormal motional changes an activation signal for a subsequent action or signal, e.g. a signal for activating the inflation of an airbag in a vehicle in a possible collision. Unlike this, the accelerometer of the alarm chip is used to detect motional changes in an object which is at rest relative to the geodetic surroundings in a normal position of use, the object for example being formed by a window or a door in a building, an installation or a structure, wherein, by abnormal motional changes, an alarm signal is transmitted to a central and/or external alarm unit/alarm system arranged to the building, installation or structure.

ADVANTAGES ACHIEVED THROUGH THE INVENTION

The use of an alarm chip according to the invention primarily has the effect that a building, installation or structure may be provided with shell-protection against burglary and undesired entry, in a simple and inexpensive way.

The possible use of wireless signal communication makes redundant, at the same time, the laying of connecting cables/wires between the alarm chip and a central and/or external alarm unit/alarm system arranged to the building, installation or structure. Windows and doors may thereby come from the manufacturer with alarm chips attached or inserted. Alternatively, the alarm chip may be retrofitted by means of simple means, e.g. tape.

The alarm chip may possibly also be provided with, or have arranged thereto, other types of sensors to the degree in which this is of advantage, or to the degree in which such sensors are being made available, such sensors being arranged either to give warning of burglary or undesired entry and/or the sensor(s) possibly being arranged for other purposes, e.g. temperature and/or smoke/gas detection.

The alarm chip concerned is also arranged to distinguish a number of non-alarm signals from alarm signals, so that there is an essentially smaller tendency towards false alarms than what is the case with many known alarm solutions.

The alarm chip also transfers signals continuously to an alarm unit/alarm system, so that the user does not have to deal with possible activation or deactivation of the alarm chip or the alarm unit/alarm system arranged to the building, installation or structure, which is necessary, for example, when PIR-detectors and magnetic contact sensors are used.

Additionally, each individual alarm chip preferably outputs unique coded signals, so that i.a. its identity and address are specifically defined relative to any other alarm chips connected to the alarm unit/alarm system.

DESCRIPTION OF AN EXEMPLARY EMBODIMENT OF THE INVENTION

The appended drawn figure (FIG. 1) shows a perspective sectional view of a window 2 formed by double window glass 4 mounted in a window frame 6, the window frame 6 being disposed in an associated window casing 8 of a building not shown. Internally, the window glass 4 has an alarm chip 10 according to the invention attached thereto. The alarm chip 10 is provided with an accelerometer, not shown in the drawn figure, an ASIC electronic signal processing circuit not shown, incorporating i.a. an analogue-to-digital converter (ADC-component) and an electronic processor for processing digital acceleration data from the accelerometer. The alarm chip 10 is moreover provided with a radio frequency transmitter (RE transmitter) not shown, and a lithium battery, not shown, providing the alarm chip 10 with electrical power. The ASIC is arranged with software in the form of suitable algorithms, e.g. seismology-based algorithms, continuously processing incoming acceleration data produced by physical influencing forces on the window glass 4. By means of this signal processing, normal motional change patterns are distinguished from abnormal notional change patterns, the normal notional change patterns occurring for example as a consequence of knocking, scraping, rain, hail, wind, acoustic waves/noise, whereas abnormal motional change patterns appear as a consequence of breaking of the window glass 4 and/or breakage of the window frame 6 or window casing 8.

In order to limit the power consumption of the alarm chip 10 the ASIC is arranged to carry out a so-called pre-filtering of incoming acceleration signals, in which the signals are first processed in a simplified part of said algorithms, and in which acceleration courses corresponding to simple and/or frequently occurring normal notional changes or patterns of motional change are recognized, in which case the ASIC is arranged to stop the forwarding of signals.

For security reasons the output signals are coded/encrypted in the ASIC before being transferred in continuous signal pulses through said radio frequency transmitter to a central and/or external alarm unit/alarm system, not shown in the drawing, connected to the alarm chip 10. Otherwise the output signals are formed of both alarm signals and non-alarm signals ("alive & well" messages), the output signals in normal circumstances mainly being made up of "alive & well" messages. In addition to being coded/encrypted, and for security reasons, "alive & well" messages are transmitted by means of the ASIC in a pseudo-random order, each message containing information to the alarm unit/alarm system about the identity of the alarm chip, when will the next message be sent and in which coded/encrypted format will this message be available. Thereby, by each "alive & well" message the alarm unit/alarm system will be ready to receive and decode the message, any irregularities in the expected signal resulting in an alarm being activated by the alarm unit/alarm system.

On detection of an abnormal motional change pattern, the alarm chip 10 outputs, by means of the radio frequency transmitter, a wireless coded/encrypted alarm signal to a radio frequency receiver, not shown in the drawn figure, connected to the alarm unit/alarm system. On detection of normal motional change patterns, the alarm chip 10 moreover outputs signal pulses in a pseudo-random order, interpreted by the alarm unit/alarm system as non-alarm signals, any interruptions or irregularities in the expected signal pulses being interpreted by the alarm unit/alarm system as alarm signals.

The invention claimed is:

1. An alarm device for alerting of burglary or undesired entry into a construction, including a building, installation or structure, the alarm device being connectable to at least one alarm unit or alarm system that is provided with a signal receiver, and that is prepared to interpret processed signals from said alarm device; wherein the alarm device comprises:

an alarm chip (10) that is suitable for being fixedly attached to an access opening medium in the construction, the alarm chip (10) being provided with at least a signal transmitter;

an energy source;

a sensor for detecting motions and vibrations of said access opening medium, and for outputting a series of analogue electric signals corresponding to said motions and vibrations, said sensor in the alarm chip (10) comprising an accelerometer that measures, at least in one direction, acceleration values (dv/dt) corresponding to said motions and vibrations;

an ADC-component (analogue to digital converter) coupled to said sensor, said component converting the analogue signals to a series of digital electric signals and outputting these signals;

an electronic signal processing circuit that is run by a processor, that processes said digital signals, that is capable of outputting processed signals to said signal receiver provided to said at least one alarm unit or alarm system associated with the construction, and that said signal processing circuit is provided with at least one algorithm containing instructions, in program form, that define acceleration signal characteristics and patters corresponding to various types of said motions and vibrations, the at least one algorithm also containing instructions for recognizing and distinguishing said acceleration signal characteristics and patterns as either alarm-justifying or non-alarm-justifying motions and vibrations of said access opening medium, and that the signal processing circuit is arranged to continuously output processed signals to said at least one alarm unit or alarm system associated with the construction, and that the signal processing circuit is arranged to output an alarm-activating signal when it recognizes acceleration signals corresponding to said alarm-justifying motions and vibrations, and to output an "alive & well" signal (a non-alarm signal) when it either recognizes acceleration signals corresponding to said non-alarm-justifying motions and vibrations, or when no motions and vibrations are recognized.

2. Alarm device according to claim 1, characterised in that said signal transmitter in the alarm chip (10) is a radio frequency transmitter, while said signal receiver is a radio frequency receiver, thereby providing wireless signal transmission between the alarm chip (10) and said at least one alarm unit or alarm system.

3. Alarm device according to claim 1, characterised in that said ADC-component, said signal processing circuit and its processor are mounted in the alarm chip (10).

4. Alarm device according to claim 1, characterised in that said ADC-component is mounted in the alarm chip (10), while said signal processing circuit and its processor are mounted external thereto and in connection with said at least one alarm unit or alarm system.

5. Alarm device according to claim 1, characterised in that said signal processing circuit is an application-specific-integrated-circuit, also denoted ASIC.

6. Alarm device according to claim 1, characterised in that said signal processing circuit is arranged to output signals in pulses.

7. Alarm device according to claim 1, characterised in that said signal processing circuit is arranged to output signals in at least one signal format or signal code.

8. Alarm device according to claim 7, characterised in that the signal processing circuit is arranged to change signal format or code at even or uneven intervals.

9. Alarm device according to claim 1, characterised in that said signal processing circuit is arranged to output non-alarm signals in a pseudo-random sequence.

10. Alarm device according to claim 1, characterised in that said signal processing circuit is arranged to output encrypted signals.

11. Alarm device according to claim 2, characterised in that said ADC-component, said signal processing circuit and its processor are mounted in the alarm chip (10).

12. Alarm device according to claim 2, characterised in that said ADC-component is mounted in the alarm chip (10), while said signal processing circuit and its processor are mounted external thereto and in connection with said at least one alarm unit or alarm system.

13. Alarm device according to claim 5, characterised in that said signal processing circuit is arranged to output signals in pulses.

14. Alarm device according to claim 5, characterised in that said signal processing circuit is arranged to output signals in at least one signal format or signal code.

15. Alarm device according to claim 14, characterised in that the signal processing circuit is arranged to change signal format or code at even or uneven intervals.

16. Alarm device according to claim 5, characterised in that said signal processing circuit is arranged to output non-alarm signals in a pseudo-random sequence.

17. Alarm device according to claim 5, characterised in that said signal processing circuit is arranged to output encrypted signals.

* * * * *